US007857651B2

(12) United States Patent
Chen

(10) Patent No.: US 7,857,651 B2
(45) Date of Patent: Dec. 28, 2010

(54) COXIAL CONNECTOR HAVING RESILIENT RING AND SEALING RING

(75) Inventor: Jin-Ping Chen, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/478,702

(22) Filed: Jun. 4, 2009

(65) Prior Publication Data

US 2009/0305560 A1 Dec. 10, 2009

(30) Foreign Application Priority Data

Jun. 4, 2008 (CN) ..... 2008 2 0037223
Jun. 6, 2008 (CN) ..... 2008 2 0038034

(51) Int. Cl.
*H01R 13/62* (2006.01)

(52) U.S. Cl. ..... 439/352; 439/357; 439/578

(58) Field of Classification Search ..... 439/352, 439/357, 578, 349, 353, 358
See application file for complete search history.

(56) References Cited

U.S. PATENT DOCUMENTS 4,929,188 A * 5/1990 Lionetto et al. ..... 439/349
5,176,533 A * 1/1993 Sakurai et al. ..... 439/352
6,709,289 B2 3/2004 Huber et al.
7,189,097 B2 * 3/2007 Benham ..... 439/352
7,329,139 B2 * 2/2008 Benham ..... 439/352

FOREIGN PATENT DOCUMENTS

CN 1960082 5/2007

* cited by examiner

*Primary Examiner*—Gary F. Paumen
(74) *Attorney, Agent, or Firm*—Ming Chieh Chang; Wei Te Chung; Andrew C. Cheng

(57) ABSTRACT

A coaxial connector (100) adapted for mating with a mating connector (200) includes a bracket (10), and a clasping portion (40) clasping the mating connector. The bracket has a central contact (30) retained in the bracket for electrically connecting with the mating connector. The clasping portion includes a base flange (41) and a number of claw portions (42) extending from the base flange. Each claw portion has an engaging portion (421) for engaging with the mating connector. The coaxial connector further includes a resilient ring (70) mounted on the engaging portion of the clasping portion to strengthen the engagement between the engaging portion and the mating connector. The coaxial connector includes a conductive resilient sealing ring (60) mounted between the bracket and the mating connector.

19 Claims, 8 Drawing Sheets

COXIAL CONNECTOR HAVING RESILIENT RING AND SEALING RING

BACKGROUND OF THE INVENTION

1. Field of the Invention

The present invention relates to a coaxial connector, and more particularly to a coaxial connector having a resilient ring interengaged with a mating connector with a strengthened engaging force, and the a sealing ring serving to provide both waterproof and radio frequency leakage proof effects.

2. Description of Related Art

CN Patent publication No. 1960082 published on May 9, 2007 discloses a male connector and a female connector mating with each other. The male connector includes a housing, a clasping portion mounted within the housing, and a rejecting portion mounted outside of the housing. The housing of the female connector is formed with a plurality of annular protrusions. The annular protrusion has a rear face extending obliquely. When the female connector is mated with the male connector, the clasping portion is engaged with the rear face of the annular protrusion.

The force produced from the clasping portion is not strong enough. When the male connector is engaged with or disengaged from the female connector for many times, the clasping portion would be abraded and could not clasp the male connector tightly. As a result, it would result in unreliable engagement between the female connector and the male connector.

Hence, an improved coaxial connector having a resilient ring for providing a strengthened engaging force is highly desired.

U.S. Pat. No. 6,709,289 issued to Huber & Suhner AG and Radiall on Mar. 24, 2004 discloses a coaxial connector mating with a mating connector. The coaxial connector comprises a metallic shell, an insulative member received in the metallic shell, a central pin embedded in the insulative member, and a latching portion mounted on the metallic shell. The metallic shell defines an opening and a receiving space for receiving the mating connector. The coaxial connector has a resilient insulative ring mounted in the metallic shell, and a resilient metallic ring mounted beyond the opening. When the mating connector is inserted in the coaxial connector, the mating connector resists against the resilient insulative ring to perform waterproof function and resists against the resilient metallic ring to perform radio frequency leakage proof function.

The waterproof function and the radio frequency leakage proof function have been respectively performed via two rings. Therefore, the cost of manufacturing the coaxial connector has been increased.

Hence, an improved coaxial connector having an improved sealing ring is highly desired.

SUMMARY OF THE INVENTION

Accordingly, an object of the present invention is to provide a coaxial connector having a resilient ring. The coaxial connector is adapted for mating with a mating connector and includes a bracket and a clasping portion clasping the mating connector. The bracket has a central contact retained in the bracket for electrically connecting with the mating connector. The clasping portion includes a base flange and a number of claw portions extending from the base flange. Each claw portion has an engaging portion for engaging with the mating connector. The coaxial connector further includes a resilient ring mounted on the engaging portion of the clasping portion to strengthen the engagement between the engaging portion and the mating connector.

When the mating connector is inserted in the coaxial connector, an engaging force produced by the claw portions of the clasping portion is exerted to the mating connector to thereby fix the mating connector in the coaxial connector. The resilient ring is fastened to the claw portions of the clasping portion to enhance the engaging force for clasping the mating connector more tightly.

In order to achieve another object set forth, a coaxial connector adapted for mating with a mating connector includes a bracket having a shoulder, and a central contact electrically connectable with the mating connector. The coaxial connector includes a clasping portion clasping the mating connector via a resilient force, and a conductive resilient sealing ring resisting against the shoulder of the bracket. When the mating connector is inserted into the bracket, the mating portion resists against the sealing ring due to the resilient force. The sealing ring is sandwiched between the shoulder of the bracket and a mating portion of the mating connector for serving to provide waterproof and radio frequency leakage proof effect.

The sealing ring formed as a conductive resilient ring could perform waterproof and radio frequency leakage proof effects simultaneously. Using one ring, instead of two rings, to perform two functions would result in cost-down of manufacturing the coaxial connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
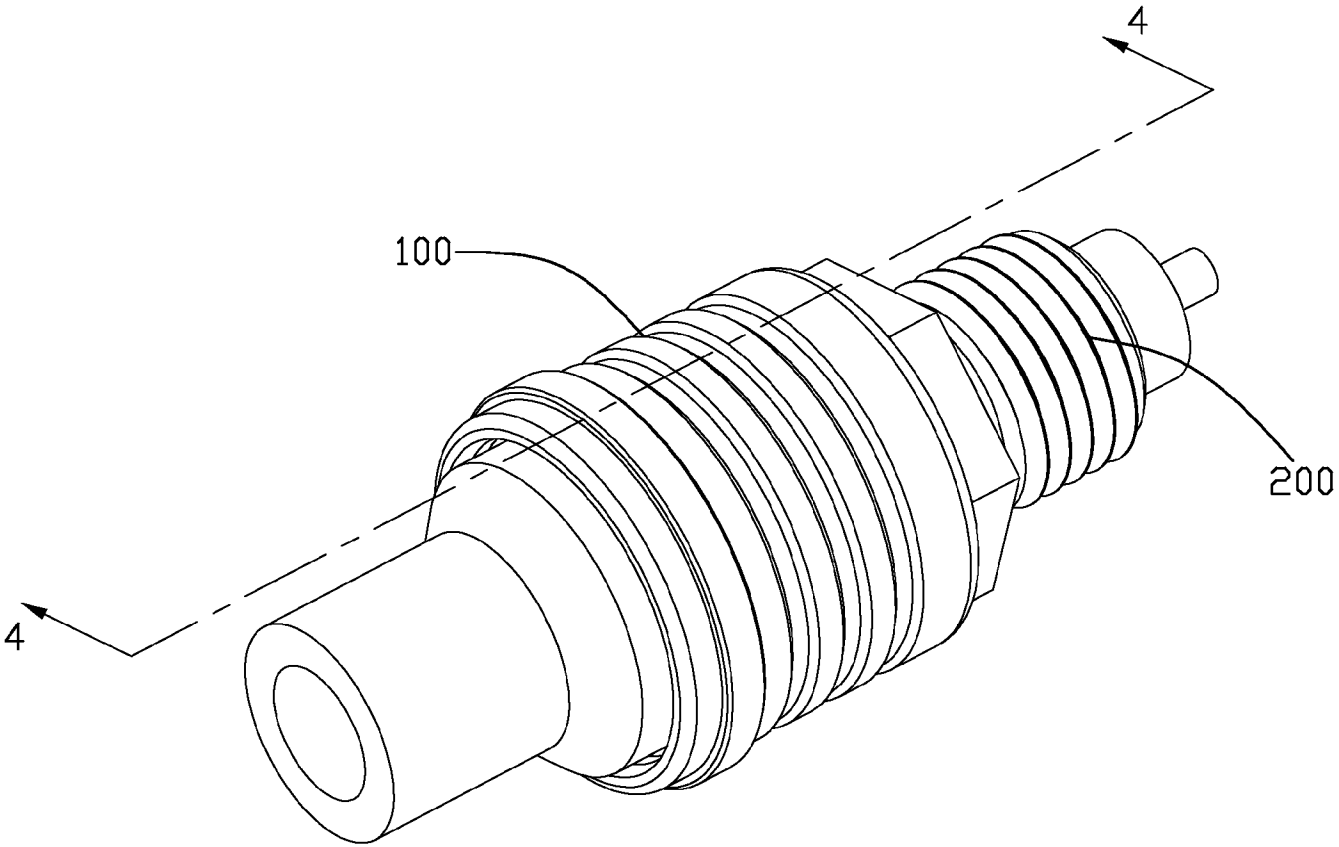
FIG. 1 is an assembled perspective view showing a coaxial connector in accordance with a first embodiment of the present invention mating with a mating connector.
Figure 2:
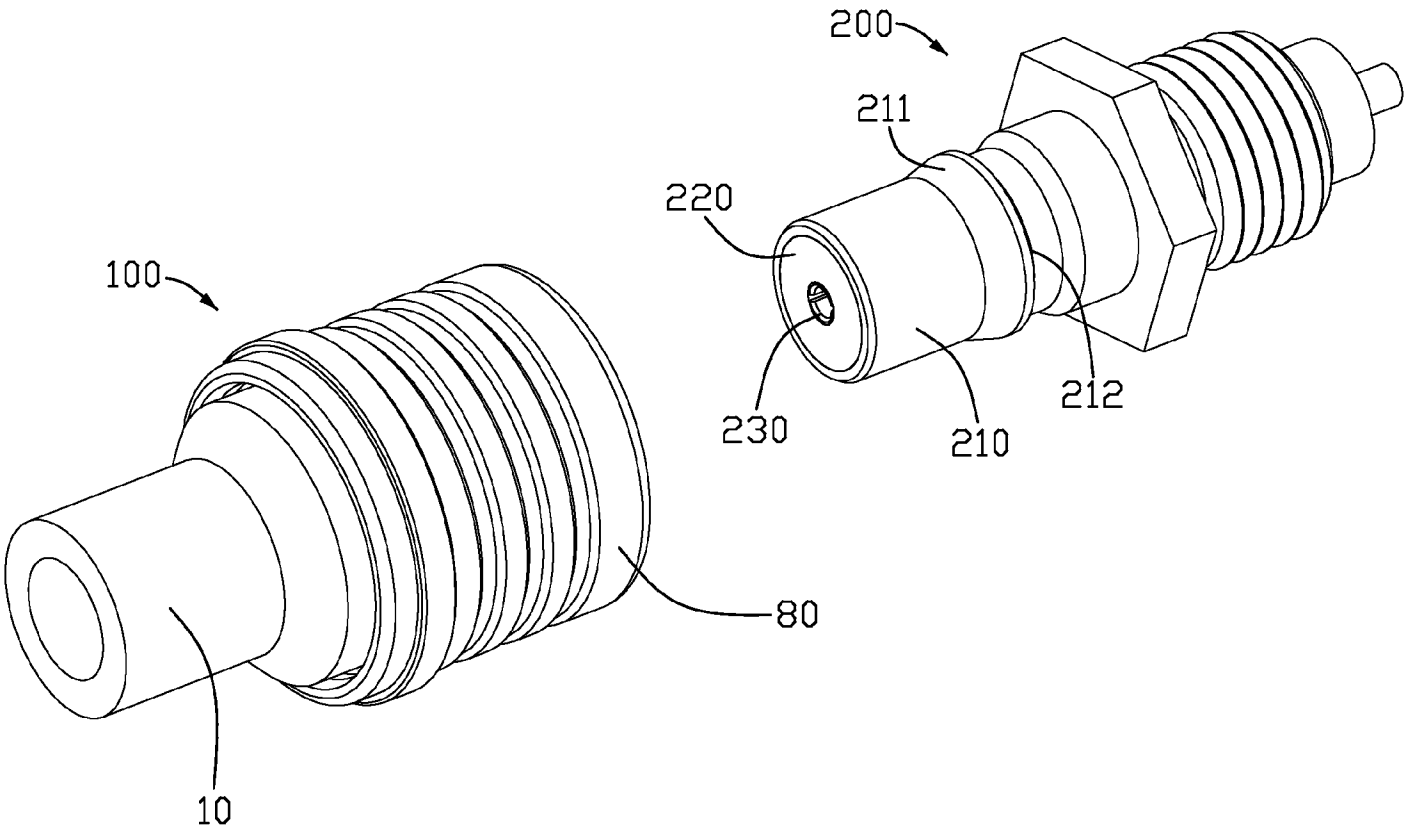
FIG. 2 is a view similar to FIG. 1, with the mating connector disengaging from the coaxial connector.

Reference will now be made in detail to the preferred embodiment of the present invention. Referring to FIGS. 1-4, in a first embodiment, a coaxial connector 100 is adapted for mating with a mating connector 200. The coaxial connector 100 comprises a bracket 10, an insulative member 20 received in the bracket 10, a central contact 30 received in the insulative member 20, and an operating portion 80 mounted outside of the bracket 1. The insulative member 20 defines a central hole 21 for insertion of the central contact 30. The coaxial connector 100 further includes a sealing ring 60, a clasping portion 40, a securing portion 50, a resilient ring 70 and a fastening ring 90 mounted in the bracket.

Figure 3:
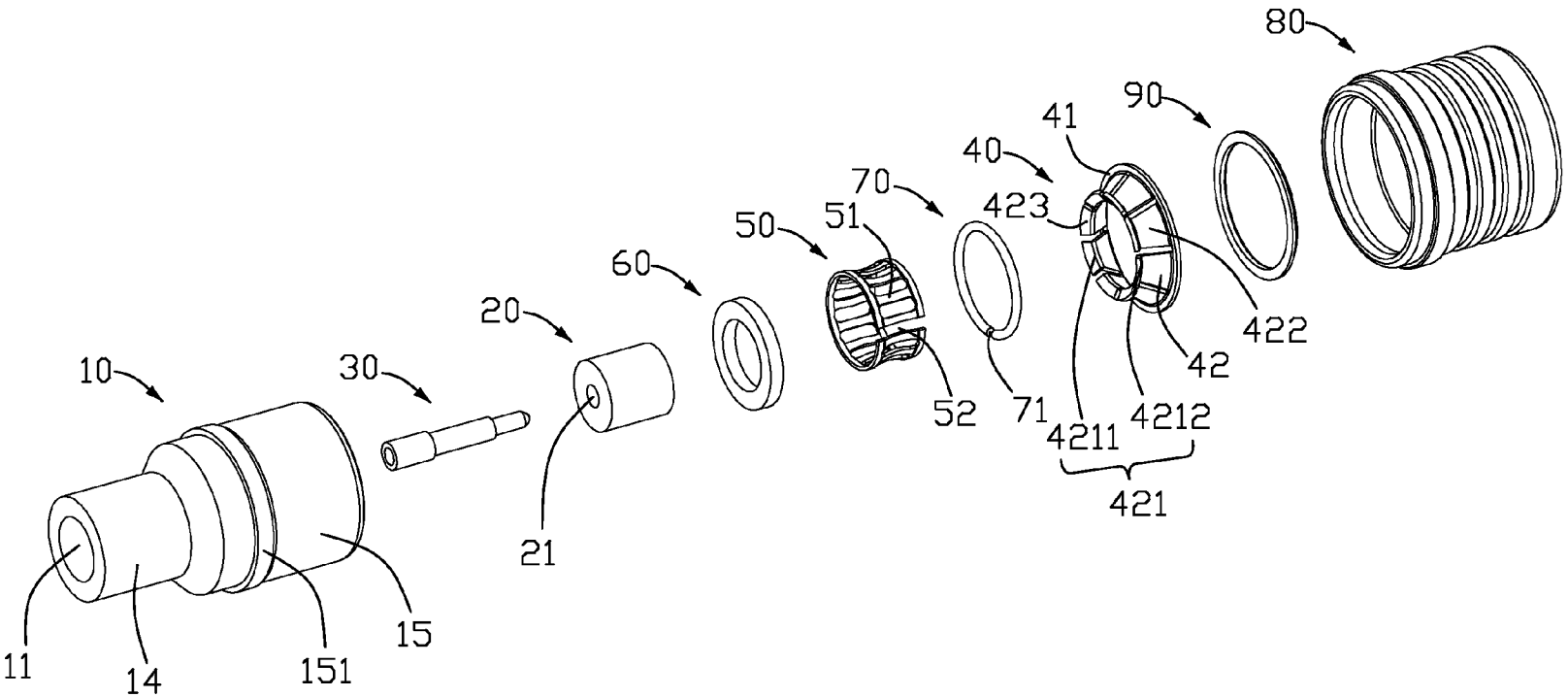
FIG. 3 is an exploded perspective view of the coaxial connector as shown in FIG. 1.
Figure 4:
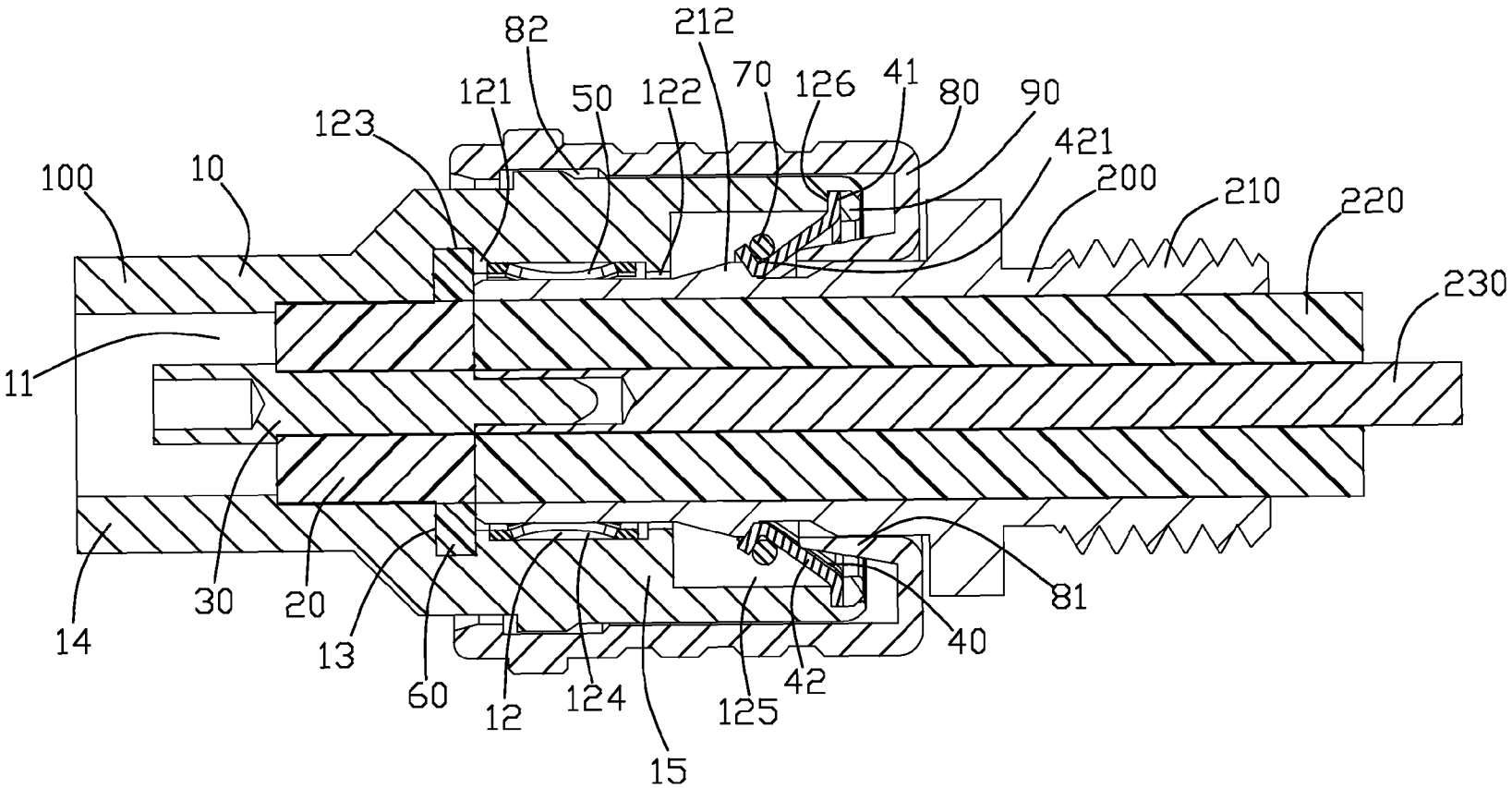
FIG. 4 is a cross-sectional view of coaxial connector and the mating connector as shown in FIG. 1, taken along line 4-4.
Figure 5:
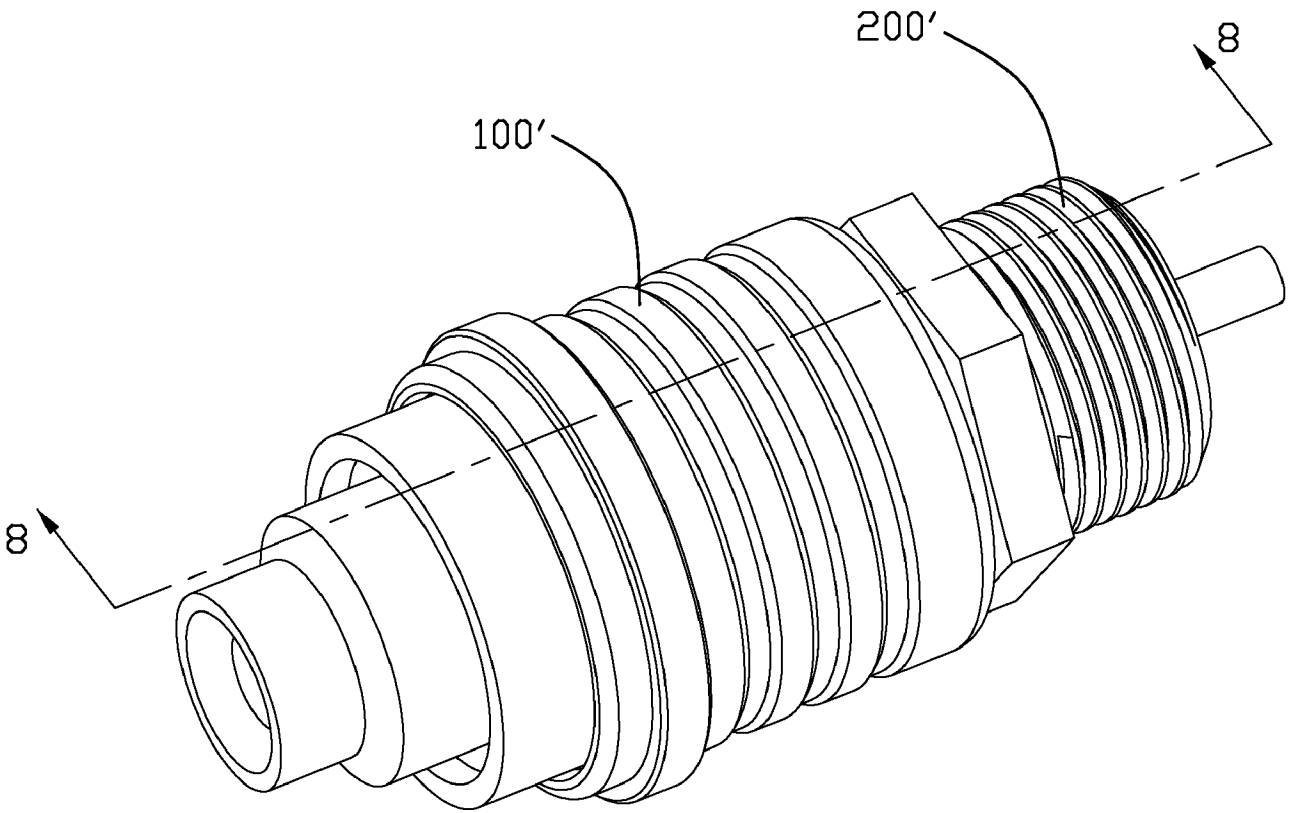
FIG. 5 is an assembled perspective view showing a coaxial connector in accordance with a second embodiment of the present invention mating with a mating connector.
Figure 6:
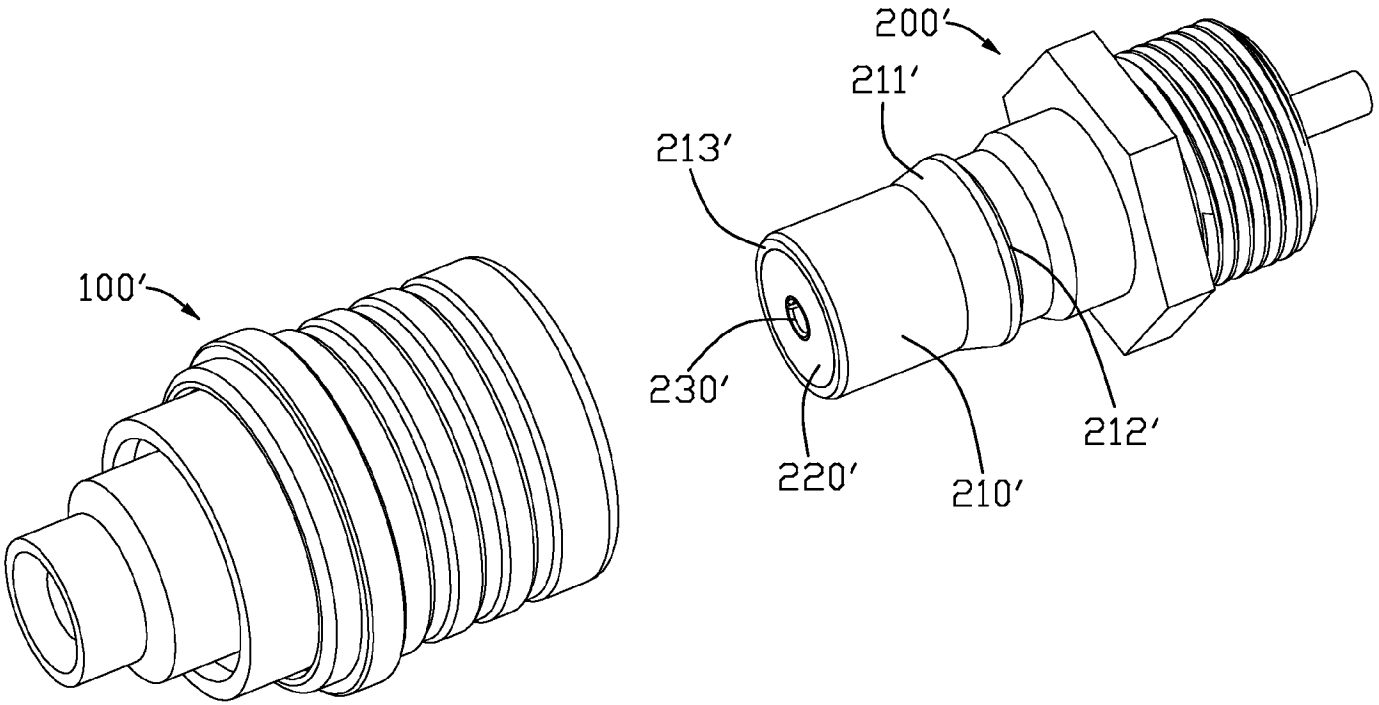
FIG. 6 is a view similar to FIG. 5, with the mating connector disengaging from the coaxial connector.

Referring to FIGS. 3 and 4, the bracket 10 comprises a base flange 15 having a protruding flange 151 formed at an outer surface of the base flange 15, and a sleeve 14 connected with the base flange 15. The bracket 10 has a receiving space 11 defined within the sleeve 14, a receiving room 12 defined within the base flange 15, and a shoulder 13 formed between the receiving space 11 and the receiving room 12. The base flange 15 has an outer diameter larger than that of the sleeve 14, and the receiving room 12 has an inner diameter larger than that of the receiving space 11.

The bracket 10 has a resisting portion 126 formed at a rear portion thereof. The bracket 10 has a first flange 121 and a second flange 122 orienting toward the receiving room 12. The receiving room 12 is divided into a first recess 123 between the shoulder 13 and the first flange 121, a second recess 124 between the first and the second flanges 121, 122, and a third recess 125 adjacent to the resisting portion 126.

The clasping portion 40 comprises a base flange 41, a plurality of claw portions 42 extending from the base flange 41 and connected with each other via the base flange 41. Each claw portion 42 includes a beam portion 422 extending toward a central axis of the clasping portion 40, a bending portion 423 bending away from the central axis, and an engaging portion 421 between the beam portion 421 and the bending portion 422. The engaging portion 421 includes an engaging protrusion 4211 protruding from an inner face of the claw portion 42 toward the central axis. The engaging portion 421 has an engaging indentation 4212 defined at an outer face of the claw portion 42.

The securing portion 50 is configured to work as a resilient sleeve. The securing portion 50 includes a side wall 51 resiliently deformable toward the central axis and defining an opening 52. The securing portion 50 could be compressible into a smaller dimension via the opening 52 thereby smoothing the insertion of itself into the bracket 10.

The resilient ring 70 is a made from sheet metal and formed into a ring defining a cutout 71. The metallic resilient ring 70 is deformable via the cutout 71. Optionally, the resilient ring 70 could also be made into a closed insulative ring.

The operating portion 80 is formed into a sleeve configuration. The operating portion 80 has a driving portion 81 formed therein.

Referring to FIGS. 1-4, in assembling of the coaxial connector 100, the securing portion 50 is mounted into the second recess 124. The clasping portion 40 is assembled to the resisting portion 126. The resilient ring 70 is plunged in the engaging indentation 4212. The fastening ring 90 is assembled to the resisting portion 126. The base flange 41 of the clasping portion 40 is sandwiched between the resisting portion 126 and the fastening ring 90. The central contact 30 is inserted through the central hole 21 of the insulative member 20. The insulative member 20 together with the central contact 30 are inserted into the receiving space 11, with the sealing ring 60 plunged in the first recess 123 for performing airproof function. The operating portion 80 is mounted outside of the bracket 10, with the driving portion 81 extending backwardly through the fastening ring 90 till abutting against the claw portion 42 of the clasping portion 40. The operating portion 80 defines a groove 82 in an inner surface thereof for engaging with the protruding flange 151 of the bracket 10.

The mating connector 200 includes a shell portion 210, an insulative portion 220 surrounded by the shell portion 210, and a central pin 230 retained in the insulative portion 220. The shell portion 210 is provided with a protruding rib 211 having a stepping face 212. The protruding rib 211 is formed along an outer side of the shell portion 210. Optionally, the protruding rib 211 could be formed into an indentation portion engageable with a protruding portion formed on the bracket 10.

When the mating connector 200 is inserted into the coaxial connector 100 along the central axis, the central contact 30 is electrically connected with the central pin 230. The side wall 51 of the securing portion 50 resiliently abuts against the shell portion 210 of the mating connector 200. The engaging portions 4211 of the clasping portion 40 resiliently resist against the stepping face 212 of the protruding rib 211 of the mating connector 200.

When the mating connector 200 is withdrawn from the coaxial connector 100, the operating portion 80 is pushed forwardly, with the protruding flange 151 of the bracket 10 sliding into the groove 82. The driving portion 81 slides along the claw portion 42 of the clasping portion 40 and outwardly spreads the claw portion 42 for disengaging the mating connector 200 from the coaxial connector 100.

The advantage of the first embodiment of the present invention is to provide the resilient ring 70. When the mating connector 200 is inserted in the coaxial connector 100, an engaging force produced by the claw portions 42 of the clasping portion 40 is exerted onto the mating connector 200 to thereby fix the mating connector 200 in the coaxial connector 100. The resilient ring 70 is fastened to an outer side of the claw portions 42 of the clasping portion 40 to strengthen the engaging force for fastening the mating connector 200 more tightly. The mating connector 200 would abut against the cushion 60 tightly due to a branch of the engaging force.

Another advantage of the first embodiment of the present invention is to provide the sealing ring 60. The sealing ring 60 is made into a conductive resilient ring. The sealing ring 60 could be made from metal-plated rubber material in this embodiment. The sealing ring 60 formed as a resilient ring could perform waterproof function. The sealing ring 60 formed as a conductive resilient ring could electrically connect with the mating connector 200 and the bracket 10. The radio frequency signal transmitted from the central pin 230 of mating connector 200 could be prevented from leaking due to the sealing ring 60. The sealing ring 60 could perform radio frequency proof function too. The sealing ring 60, instead of two rings, could serve to provide waterproof and radio frequency leakage proof effects simultaneously. The cost of manufacturing the coaxial connector 100 has been reduced.

A second embodiment is shown in FIGS. 5-8, with the resilient ring 70 being removed. The coaxial connector 100' referred in the second embodiment is adapted for mating with a mating connector 200'. The coaxial connector 100' comprises a bracket 10', an insulative member 20' received in the bracket 10', and a central contact 30' inserted in the insulative member 20'. The insulative member 20' defines a central hole 21' for insertion of the central contact 30'. The coaxial connector 100' further comprises a sealing ring 60', a securing portion 70', a clasping portion 40', a fixing portion 80', and an operating portion 50' assembled to the fixing portion 80'.

Figure 7:
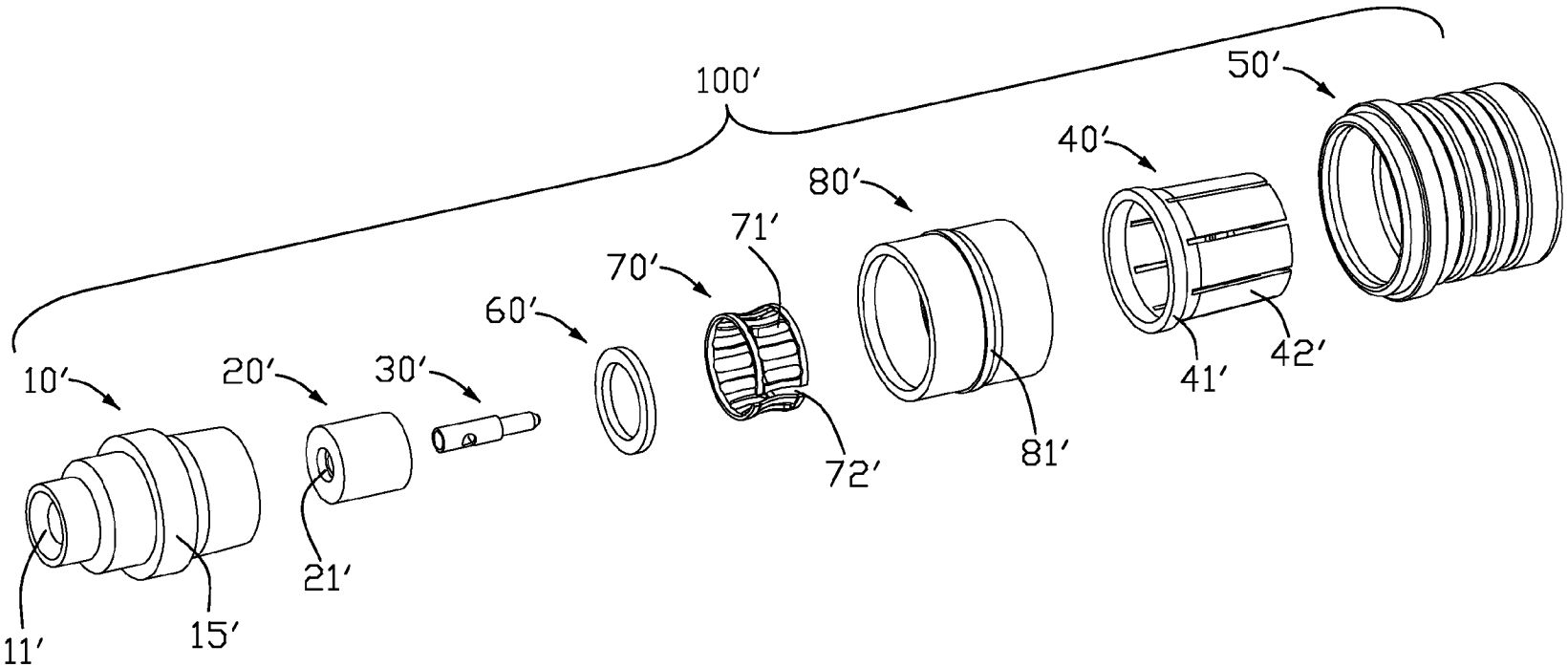
FIG. 7 is an exploded perspective view of the coaxial connector as shown in FIG. 5.
Figure 8:
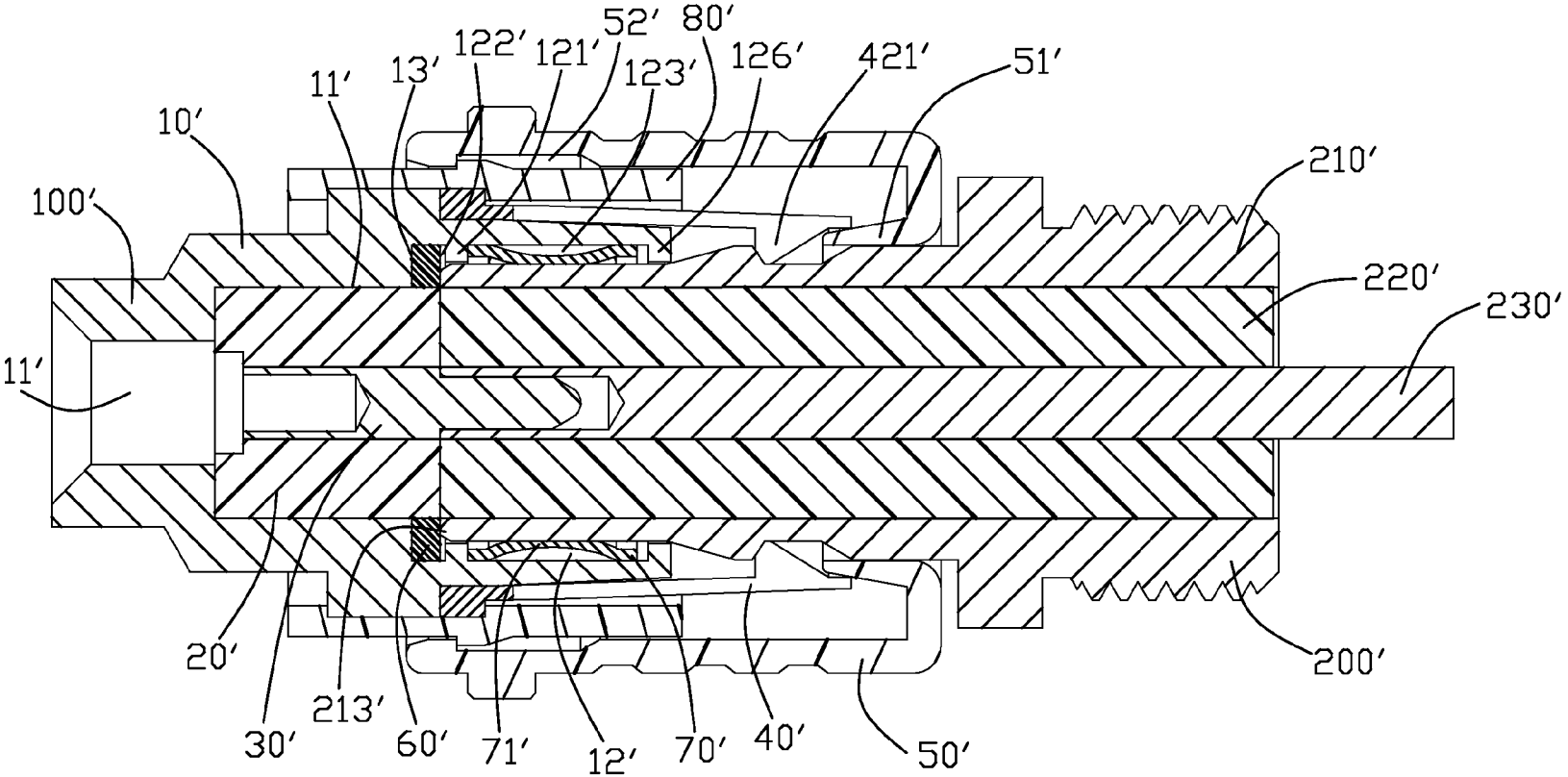
FIG. 8 is a cross-sectional view of coaxial connector and the mating connector as shown in FIG. 5, taken along line 8-8.

Referring to FIGS. 7 and 8, the bracket 10' has a protruding flange 15' formed around an outer surface thereof. The bracket 10' has a receiving space 11' defined at a front portion thereof, a receiving room 12' communicating with the receiving space 11', and a shoulder 13' formed between the receiving space 11' and the receiving room 12'. The receiving room 12' has an inner diameter larger than that of the receiving space 11'. The bracket 10' has a first flange 121' and a second flange 126' orienting toward the receiving room 12'. The receiving room 12' is divided into a first recess 122' between the shoulder 13 and the first flange 121', and a second recess 123' between the first and the second flanges 121', 126'.

The sealing ring 60' referred in the second embodiment has a configuration similar to that of the sealing ring 60 referred in the first embodiment.

The securing portion 70' is configured to work as a resilient sleeve. The securing portion 70' includes a side wall 71' resiliently deformable toward a central axis and defining a cutout 72'. The securing portion 70' could be compressible into a smaller dimension via the cutout 72' for smoothing the insertion of itself into the bracket 10'.

The clasping portion 40 comprises a base portion 41', a plurality of beam portions 42' extending from the base portion 41' and connected with each other via the base portion 41'. Each beam portion 42' has a rear flange protruding inwardly to form an engaging portion 421'.

The fixing portion 80' has a projecting flange 81' formed around an outer surface thereof.

The operating portion 50' is formed into a sleeve configuration. The operating portion 50' has a driving portion 51' formed therein. The operating portion 50' has a groove 52' defined around an inner surface thereof.

Referring to FIGS. 5-8, in assembling of the coaxial connector 100', the securing portion 70' is mounted into the second recess 123' of the bracket 10'. The central contact 30' is inserted through the central hole 21' of the insulative member 20'. The insulative member 20' together with the central contact 30' are inserted into the receiving space 11', with the sealing ring 60' encircling around the insulative member 20' and plunged in the first recess 122' for performing sealing function. The clasping portion 40' is assembled to the bracket 10', with the base portion 41' resisting against the protruding flange 15'. The fixing portion 80' is assembled to the protruding flange 15' for fixing the base portion 41' of the clasping portion 40 onto the protruding flange 15'. The operating portion 50' is mounted outside of the fixing portion 80', with the driving portion 81' extending backwardly till abutting against the engaging portion 421' of the clasping portion 40'. The projecting flange 81' of the fixing portion 80 is slidable along the groove 52' of the operating portion 50'.

The mating connector 200' includes a shell portion 210', an insulative portion 220' surrounded by the shell portion 210', and a central pin 230' retained in the insulative portion 220'. The shell portion 210' has a protruding rib 211' having a stepping face 212' formed at an outer side, and a mating portion 213' formed at a front portion thereof. The protruding rib 211' is formed around an outer side of the shell portion 210'. Optionally, the protruding rib 211' could be formed into an indentation portion engageable with a protruding portion formed on the coaxial connector 100'.

When the mating connector 200' is inserted into the coaxial connector 100' along the central axis, the central contact 30' is electrically connected with the central pin 230'. The side wall 71' of the securing portion 70' resiliently abuts against the shell portion 210' of the mating connector 200'. The engaging portion 421' of the clasping portion 40' resiliently resists against the stepping face 212' of the protruding rib 211' of the mating connector 200'. A resilient force produced from the clasping portion 40' is exerted to the shell portion 210' of the mating connector 200'. The mating portion 213' of the shell portion 210' resists against the sealing ring 60' via a branch of the resilient force. The sealing ring 60' is sandwiched between the shoulder 13' of the bracket 10' and the mating portion 213' of the mating connector 200' along the axial direction and sandwiched between the insulative member 20' and bracket 10' along an up-to-bottom direction.

When the mating connector 200' is withdrawn from the coaxial connector 100', the operating portion 50' is pushed forwardly, with the projecting flange 81' of the fixing portion 80' sliding within the groove 52'. The driving portion 51' slides along the engaging portion 421' of the clasping portion 40' and outwardly spreads the engaging portion 421' for disengaging the mating connector 200 from the coaxial connector 100'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coaxial connector adapted for mating with a mating connector, said coaxial connector comprising:

a bracket defining a receiving room for insertion of the mating connector;

a central contact retained in the bracket for electrically connecting with the mating connector;

a clasping portion assembled to the bracket for clasping the mating connector, said clasping portion comprising a base flange and a plurality of claw portions extending from the base flange, each claw portion having an engaging portion for engaging with the mating connector; and a resilient ring mounted on the engaging portion of the clasping portion to strengthen the engagement between the engaging portion and the mating connector.

2. The coaxial connector as claimed in claim 1, wherein said resilient ring is made from metal material and formed into a ring having a cutout.

3. The coaxial connector as claimed in claim 1, wherein said claw portion of the clasping portion comprises a beam portion extending from the base flange toward a central axis of the coaxial connector and a bending portion extending away from the central axis, the engaging portion being located between the beam portion and the bending portion.

4. The coaxial connector as claimed in claim 3, wherein said engaging portion has an engaging protrusion protruding toward the central axial from an inner face of the claw portion, and an engaging indentation defined at an outer face of the claw portion, said resilient ring plunged in the engaging indentation of the claw portion.

5. The coaxial connector as claimed in claim 4, wherein said bending portion of the clasping portion is engageable with a protruding rib formed along an outer side of the mating connector.

6. The coaxial connector as claimed in claim 3, further comprising a fastening ring, and wherein said bracket has a resisting portion, said base flange of the clasping portion sandwiched between the resisting portion and the fastening ring.

7. The coaxial connector as claimed in claim 3, further comprising an operating portion assembled to the bracket, and the operating portion having a driving portion, said driving portion sliding along the beam portion and outwardly spreading the claw portion of clasping portion due to a forward movement of the operating portion.

8. The coaxial connector as claimed in claim 1, wherein said bracket is formed with a first and a second flanges orienting toward the receiving room, and wherein said coaxial connector comprises a securing portion restricted between the first and second flanges and resiliently resisting the mating connector.

9. The coaxial connector as claimed in claim 1, further comprising an insulative member defining a central hole insertion of the central contact, and wherein said insulative member together with the central contact is mounted in the bracket, with the central contact in contact with a central pin of the mating connector.

10. A coaxial connector assembly comprising:

a coaxial connector having a bracket defining a receiving room, a central contact disposed in the receiving room, a clasping portion assembled to the bracket, said clasping portion comprising a base flange and a plurality of claw portions extending from the base flange, each claw portion having an engaging portion;

a mating connector mating with the coaxial connector along a central axis, said mating connector being inserted in the receiving room and clasped by the clasping portion, said mating connector comprising a central pin in contact with the central contact of the coaxial connector, a shell portion formed with a protruding portion engageable with the engaging portions of the coaxial connector, said coaxial connector having a resilient ring mounted on the engaging portion of the clasping portion to strengthen the engagement between the engaging portion of the coaxial connector and the protruding portion of the mating connector.

11. The coaxial connector assembly as claimed in claim 10, wherein the coaxial connector further comprises an operating portion formed with a driving portion, said driving portion outwardly spreading both the engaging portion of the clasping portion and the resilient ring, due to a forward movement of the operating portion for releasing engagement between the engaging portion of the coaxial connector and the protruding portion of the mating connector during un-mating.

12. A coaxial connector adapted for mating with a mating connector having a mating portion, said coaxial connector comprising:

a bracket defining a receiving room and formed with a shoulder;

a central contact disposed in the receiving room and electrically connectable with the mating connector;

a clasping portion assembled to the bracket for clasping the mating connector via a resilient force;

a conductive resilient sealing ring resisting against the shoulder of the bracket; and an insulative member enclosing the central contact and mounted in the bracket, said sealing ring encircling around the insulative member and sandwiched between the bracket and the insulative member along an up-to-bottom direction, when the mating connector is inserted into the receiving room, the mating portion resisting against the sealing ring due to the resilient force, said sealing ring being sandwiched between the shoulder of the bracket and the mating portion of the mating connector along a mating direction perpendicular to said up-to-down direction for serving to provide waterproof and radio frequency leakage proof effects.

13. The coaxial connector as claimed in claim 12, wherein said sealing ring is made from metal-plated rubber material.

14. The coaxial connector as claimed in claim 12, wherein said bracket is formed with a first flange, said receiving room is divided into a first recess between the shoulder and the first flange for receiving the sealing ring.

15. The coaxial connector as claimed in claim 14, further comprising a securing portion, wherein said bracket is formed with a second flange, said receiving room is divided into a second recess between the first and second flanges for receiving the securing portion.

16. The coaxial connector as claimed in claim 15, wherein said securing portion comprises a resiliently deformable side wall resisting against the mating connector, and wherein said side wall of the securing portion defines a cutout, said securing portion being compressible into a smaller dimension via the cutout for smoothing the insertion of itself into the bracket.

17. The coaxial connector as claimed in claim 12, wherein said bracket has a protruding flange formed along an outer face thereof, and wherein said clasping portion comprises a base portion abutting against the protruding flange, and a plurality of beam portions each having an engaging portion engageable with a protruding rib formed on the mating connector.

18. The coaxial connector as claimed in claim 17, further comprising a fixing portion mounted on the protruding flange of the bracket for fixing the base portion of the clasping portion onto the protruding flange.

19. The coaxial connector as claimed in claim 18, further comprising an operating portion mounted on the fixing portion and formed with a driving portion, said driving portion outwardly spreading the engaging portion of the clasping portion, due to a forward movement of the operating portion.

* * * * *